US006313594B1

(12) United States Patent
Janutta

(10) Patent No.: US 6,313,594 B1
(45) Date of Patent: Nov. 6, 2001

(54) PARTITION WALL SYSTEM HAVING A DRIVE MECHANISM, AND DRIVE SYSTEM FOR A PARTITION WALL SYSTEM

(75) Inventor: Reinhard Janutta, Verl (DE)

(73) Assignee: DORMA GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/473,620

(22) Filed: Dec. 29, 1999

Related U.S. Application Data

(63) Continuation-in-part of application No. PCT/EP99/00030, filed on Jan. 6, 1999.

(30) Foreign Application Priority Data

Apr. 30, 1998 (DE) ..... 198 19 279

(51) Int. Cl.[7] ..... E05F 15/20

(52) U.S. Cl. ..... 318/466; 318/283; 318/603; 318/4; 52/243.1; 160/21

(58) Field of Search ..... 318/4–30, 260–289, 318/460–499; 52/1, 64, 238.1, 243.1; 49/1, 6, 31; 174/48; 160/214

(56) References Cited

U.S. PATENT DOCUMENTS

| | | | | |
|---|---|---|---|---|
| 3,683,100 | | 8/1972 | Deal et al. . | |
| 5,152,332 | * | 10/1992 | Siener | 160/188 |
| 5,406,761 | * | 4/1995 | Hobbiebrunken et al. | 52/243.1 |
| 5,625,266 | * | 4/1997 | Stark | 318/466 |
| 5,804,931 | * | 9/1998 | Schack | 318/4 |
| 5,815,987 | * | 10/1998 | Beasley | 52/65 |
| 6,079,162 | * | 6/2000 | Hein | 52/1 |
| 6,082,053 | * | 7/2000 | Bischof et all | 52/64 |

FOREIGN PATENT DOCUMENTS

| | | | |
|---|---|---|---|
| 116096 | | 5/1996 | (CH) . |
| 3150581 | | 6/1983 | (DE) . |
| 3346416 | | 7/1985 | (DE) . |
| 4208121-A1 | * | 9/1993 | (DE) . |
| 4243504 | | 6/1994 | (DE) . |
| 4424660 | | 9/1995 | (DE) . |
| 0911455-A1 | * | 4/1999 | (EP) . |
| 9-254708 | * | 9/1997 | (JP) . |
| 9742388 | | 11/1997 | (WO) . |

* cited by examiner

*Primary Examiner*—Paul Ip
(74) *Attorney, Agent, or Firm*—Nils H. Ljungman & Associates

(57) ABSTRACT

A drive system for a partition wall system composed of several individual components which are horizontally movable via rollers or appropriate media at or in a guide rail mounted to a ceiling in a way or technique in which the individual components present separate drive media which convey the corresponding component(s) independently from and/or simultaneously with the other components along the guide rail. A central control unit combined with a microprocessor and several memories is provided and the control unit's output signal transmits data and addresses to all drive media via at least a two-wire connection (databus) simultaneously to activate the individual component's drive media, which allows the individual control and regulation of the individual components and the additional miscellaneous functions for the individual components respectively inside the individual components. Changing of data and addresses is operated by a control terminal.

20 Claims, 4 Drawing Sheets

PARTITION WALL SYSTEM HAVING A DRIVE MECHANISM, AND DRIVE SYSTEM FOR A PARTITION WALL SYSTEM

CONTINUING APPLICATION DATA

This application is a Continuation-In-Part application of International Patent Application No. PCT/EP99/00030, filed on Jan. 6, 1999, which claims priority from Federal Republic of Germany Patent Application No. 198 19 279.7, filed on Apr. 30, 1998. International Application No. PCT/EP99/00030 was pending as of the filing date of the above-cited application. The United States was an elected state in International Application No. PCT/EP99/00030.

BACKGROUND OF THE INVENTION

1. Field of the Invention:

The invention relates to a drive system for a partition wall system consisting of individual components, whereas some of the components are equipped with drive media allowing their automatic moving. The individual components are horizontally movable, by means of rollers or other devices at or in a guide rail mounted on the ceiling, in a way that the individual components can be automatically displaced from a line-up arrangement into a jammed parking position. Here at least part of each of the individual components is provided with separate drive media, which guide the corresponding components independently and/or simultaneously from the other components along the guide rail. The control is realized by a central control unit combined with a microprocessor, the output signal of which activates the data and the addresses via at least a two-wire connection (databus) to all drive media. Technically seen, it is also possible to employ an extra control line in addition to the two-wire connection. It is possible to individually control and regulate the individual components, for both their driving speed as well as the additional functions. Furthermore, in addition to the utilization of a direct-current drive, a control unit may be put to use which realizes the control and the regulation of the individual components via existing low voltage lines. All program data may be readout or changed on a control terminal.

2. Background Information:

A device and procedure for the operation of an automatic partition wall system is described in the German Patent No. 44 24 660 C1, in which the individual components are horizontally moved by means of a common drive. Moreover, the installation is conceived in that an existing movable partition wall system is equipped subsequently with a motorized drive which allows the movement of individual components by motor power. For this type, the already existing manually operated system is not exchanged, which means the individual components may also be moved manually. For automatization purposes, an additional rail system is mounted on the ceiling in front of the existing guide rail in which the individual components of the partition wall system are displaced. Switchable coupling equipment provided with an identification system runs in this rail system to detect single components containing corresponding indicators and to transfer them into the generally pivoted parking position. An electrical motor propelling an endless belt via a deflection roller drives the whole device. The identification system is controlled in connection with a programmable control unit in a way that, after a trial learning run, it recognizes the individual components and transports them into the desired parking position or into the partition wall's closed position.

The Swiss patent application 1160/96, which as of yet has not been published, with the title "Moving Wall" describes a moving wall with a motor drive where the individual moving wall components present media that run the corresponding moving wall component along a guide rail independently from the other moving wall components. Moreover, each moving wall component is provided with its own drive unit with an electrical motor as the drive media. The electrical motor's driving shaft is again equipped with media through which the working junction, together with a working surface or working profile arranged along the guide rail or almost parallel to the latter, drives the moving wall component along the guide rail. In order to realize conveyance of the individual moving wall components along the guide rail, a current collector appliance is installed in working junction with the line current bar appliance, and is moved along the line current bar appliance arranged stationary side by side to the guide rail. Here, while conveying the moving wall component, the line current bar appliance is rendered electrically conductive to trigger the drive motor's activation so as to control the partition wall system in individual partial sections. At least one out of the two line current bars is divided into multiple sections insulated against each other, that is to say tappings, that may be powered individually and purposefully via a power pack. Such installation is very expensive, especially with greater or larger installations since a large number of line current bars would have to be mounted.

The German Patent No. 31 50 581 A1 reveals a control procedure for remote control operation on low voltage lines. Here, signals coming from a central station are transferred to numerous sub-stations exactly via low-voltage lines on which a high frequency signal is modulated. For postal reasons, the signal emission is only allowed when a predetermined transmitting power is not exceeded. This procedure employs a modification of signal lengths and frequencies to reach a maximum transmitting level and, by doing this, limits the data volume.

German Patent No. 33 46 416 A1, for example, shows an installation for communication engineering to transmit information according to the aforementioned method. With this equipment a HF-signal is superimposed between a sender and a receiver at low-frequency main voltage. For this purpose, sender and receiver stations are respectively connected to different outer conductors. With the intent to achieve a secure information transfer from one outer conductor to another outer conductor, electronic couplers designed as LC resonance links are described. Principally, these electronic couplers transmit the useful signals in a substantially loss-free manner. In addition, they represent a suppressor to the low-frequency main voltage, such that corresponding safety requirements are respected.

Another procedure and arrangement to control communication terminals is disclosed by German Patent No. 42 43 504 A1. Here, one or more input devices and a display device are arranged in a room. Data is transferred to another local control unit via the input device by pushing buttons. When selecting functional buttons accordingly on the input device a pre-selection is made as to which of the linked communication terminals should be finally activated.

Moreover, so-called remote controls for the existent electric network are known in installation engineering representing, for example, 256 device addresses that are activated directly via a keyboard. A general, easy-to-survey LCD screen displays these corresponding functions simultaneously. Further to the manual input, these operations may be automated by using appropriate programmable memories. It is conceivable that such control can automatically activate and also deactivate, for example, blinds, lights, etc.

Likewise, there is a controller supervising the usual operations. Also, in case of absence of persons, memorized information may be requested and activated via telephone by means of a suitable electronic device.

OBJECT OF THE INVENTION

The object of the present invention is to simplify the state of the art in conceiving a simple activation modus for automatically operated partition wall systems and, moreover, that such device may be manufactured economically in multiple partial components.

SUMMARY OF THE INVENTION

The object of the present invention can be achieved in a drive system for a partition wall system including several individual components supported at or in a hanging bearing from guide rails mounted to a building's ceiling, which components can be horizontally movable by means of rollers or appropriate media in a way or technique such that the individual components can be automatically guided from their line-up arrangement into a parking position; whereby at least part of the individual components can be equipped with separate drive media in form of leaf drive units that convey the relevant component or components independently from and/or simultaneously with the other components along the guide rail. A central control unit with a microprocessor, several memories, encoders and decoders can be provided, and via at least a two-wire connection in the form of a databus the central control unit's output signal can transmit data and addresses to all leaf drive units substantially simultaneously to activate the individual component's leaf drive units, which control unit can allow individual control and regulation of the individual components and additional miscellaneous functions for the individual components or in the individual components. The read in or read out and changing of data and addresses can be realized by means of a control terminal. Further features of the present invention are discussed herebelow.

The partition wall system can consist of several individual components, each provided with drive media to drive the individual components. In that case, the components may be conveyed such that they can be horizontally moved via rollers inside or at a guide rail system hanging, for example, from a ceiling. Conveying can be especially necessary when, for example, the individual components are to be automatically conveyed, for example, out of their line-up arrangement, that is to say closed frontage, into a generally laterally located parking position (station). In this case, it may be a partial opening or also a complete opening of the whole frontage. In a counter-move, the parked components may have to be transferred from the parking position back into the closed frontage. The individual components may be conveyed independently and/or simultaneously inside the guide rails. Each separate component that is to be conveyed individually can present a corresponding drive unit with an electric motor, preferably a direct current motor. Components that are not to be conveyed individually may not present a drive unit. The individual electric motor can be respectively activated by means of a central control unit, which can be equipped with a microprocessor and can energize all the individual components contained in a wall. Here, the central control unit's output signal can be substantially simultaneously transferred to all individual drive media through a two-wire system (databus). In addition to data on speed and position, the output signal can contain especially data defining an identification and, inherently, the address of the individual component. This can make possible the individual control and regulation of the individual components, whereby, simultaneously, additional miscellaneous functions may be realized, such as, constitutional or characteristics of the components or also, for example, as to control turnouts in order to guide the components into different stations. Changing of the data and addresses can be performed by means of the control terminal by wireless connection and also by cable connection.

The present state of the art allows conveying only one component respectively via one selection line, whereas the present invention can realize the desire to control several components independently from one another via a databus. The realistic operation of a partition wall system almost essentially requires, and that can be a principal prerequisite, the controlling of the individual components independently from one another in order to realize a quick opening as well as a partial opening with the lowest possible effort.

In the case of the Swiss patent application 1160/96, each individual component that is to be independently controlled is provided with its own electric circuit. In a station area it is also possible to switchably design individual track sections at relatively high expense.

Because of the central control unit according to the present invention, which can present, besides the microprocessor, also suitable memories to store the individual programs and addresses, it is possible to regulate and to control a large number of partial components essentially completely independent from one another via a two-wire connection. The installation no longer has to be divided into individual electric circuits. To identify the individual components, they can each receive a so-called address, essentially consisting, for example, of a number. This address can be entered by means of the employed manual terminal, and the central control unit will then recognize the individual components, and then control and regulate them according to the selected program. This is feasible independently wherever the individual partial component may be positioned within the guide rail. Of course, it is also conceivable that in such installations traditionally operated track sections could continue to exist to realize special functions that should not be influenced by the control terminal.

For programming an individual component, the component's corresponding address can be selected on the control terminal. Substantially simultaneously the central control unit can check whether the address entered is valid, and, if not, a suitable message is displayed on the terminal. Then the corresponding speed at which the individual component should be conveyed may be programmed, which speed can be a uniform speed, a reduced speed adapted to curves (guide rail) and to the positioning of the individual components, or also an accelerated speed. The microprocessor within the central control unit can transform the information on the one side into the appropriate component's address and the speed. In this case the data can be transmitted serially via the databus, and, simultaneously, a reply coming from the individual component can be transferred to the central control unit, in order to know on the one hand where the component is essentially exactly positioned within the complete guide rail system, and on the other hand to know at which speed it is conveyed and whether all preset parameters are executed by the software, especially additional functions and orders.

For the databus execution, it is advantageous to realize a two-wire system, for example, as line current bars, which can allow reception of the corresponding data and addresses by means of the individual component's slipers. For this purpose, a decoder can be provided inside the individual component's drive unit, which decoder can decode accordingly the particular data and addresses emitted by the central control unit and make these facts accessible and store them to a memory that is also incorporated in the drive unit.

At the same time, the decoder can verify whether the emitted address is compatible with its memorized address. In case the address is-not compatible, this particular partial component may not move at all, and in this case can ignore the received data, which means at substantially the same time, the stored data, for example, for speed and miscellaneous functions, can be preserved. Only when the central control unit sends the right address can the decoder process this information and emit according or corresponding data to the drive unit. The drive unit can then execute the corresponding speed with respect to the particular specific functions.

Besides conveying individual partial components, it is also conceivable, for example, to switch turnouts via the same databus, that is to say the same electric supply lines. In such case, the turnouts can also be electrically combined with the databus and likewise provided with a corresponding address, which implies simultaneously the presence of a memory and a decoder inside the turnout. The central control unit can be able to transmit according or corresponding data to the selected turnout such that this turnout takes the intended position.

The central control unit delivers a digital voltage, which has two extreme values (peak values) that can be in the positive range and negative range. The definition is made such that the central control unit, in case it does not deliver any data to the databus, can transmit a rest level situated in the negative voltage range. When data is sent, the voltage can change from the negative to the positive range. Thus it is possible to use the according or corresponding data for additional functions from the digital voltage's negative range, as this predominates with regard to the positive range. Thereby, it is conceivable that particular switching operations are not imperatively linked to conveying the component. Consequently, it is possible that in this digital system the voltage can be independent from the individual component's conveying voltage. There can be, so to say, at essentially all times a positive mean value in voltage that is used to supply the drive motor, whereas the miscellaneous functions can be supplied from the negative range in the digital voltage, that is to say via a halfway rectification.

The aforementioned descriptions or embodiments clearly show that with components equipped with the suitable electric motor within the drive unit, a custom designed displacement and thus conveying of the individual components may be realized in a simple and inexpensive way without having to change the central control unit. A databus with two interconnection lines may be required, but additional expensive wiring may not be not necessary. Furthermore, there can be the option, for example, to realize additional functions, e.g., opening or closing blinds inside a component; activating or deactivating a component's locking against unintended opening; rendering a glass pane obscure via suitable voltage application (Privalight); and executing additional control functions to switch turnouts in that individual partial components are guided to different stations so that stations do not demand too much space and likewise to admit conveying at different speed within certain track sections.

Furthermore to the aforementioned activation kind of the individual partition wall components, it is conceivable to realize and thus execute essentially all functions described above by means of a network bus, that is to say an adequate HF-signal can be superimposed on a low-frequency voltage line (scale-of-two circuit). The HF-signal can contain essentially all relevant data for the individual component's drive units, which will then, according to the information stored in their memories after decoding, execute the intended movements of the component(s). In this case too, a terminal may be employed which can provide to the user the possibility to program and then automatically run the relevant control and regulation functions. This is particularly significant, especially with regard to store opening hours, so that timed operations are automatically performed using the corresponding program memories, e.g. opening and closing the partition wall or realizing only partial opening or partial closing.

Power supply to the whole partition wall system can be either executed by means of separate line current bars running alongside the guide rails, or it is also feasible to integrate the line current bars into the guide rails. In another possible embodiment of the present invention, it would be possible that when separating the guide rail correspondingly, the guide rail could substantially simultaneously act as a line current bar.

Essentially all data relevant to control such partition wall system without essentially any problem may be transmitted by induction, for example, to the system. In that case, the power supply could also be Y-transmitted. Furthermore, it is also conceivable that only the data is radioed or transmitted by infrared to the databus.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may-be patentable and non-obvious one with respect to the other.

BRIEF DESCRIPTION OF THE DRAWINGS

The invention is explained in detail on the basis of one possible embodiment or example represented by a diagram.

DESCRIPTION OF THE PREFERRED EMBODIMENTS

Figure 1:
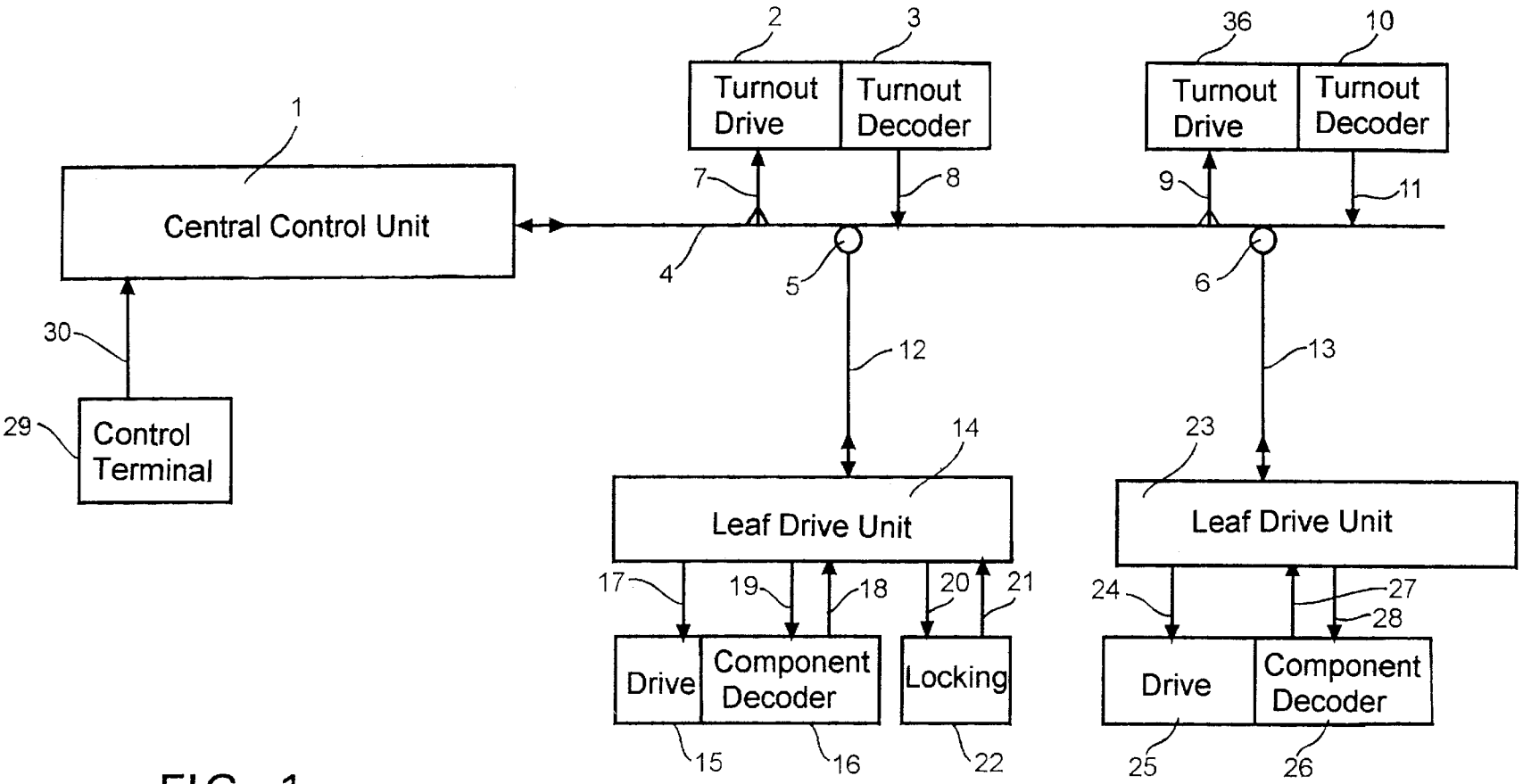
FIG. 1 shows a functional block diagram of a control for several components of a partition wall system.

FIG. 1 represents a control unit 1 that is connected via an electrical interconnection 30 to a control terminal 29. In a modification of the execution type, the electrical interconnection 30 may be eliminated and the control terminal 29 may radio its data to the control unit 1 in order to control and change the complete system. The control unit 1 is linked to a system of line current bars 4, whereby in FIG. 1 for simplicity reasons only shows one line current bar 4. Current collectors 5, 6, directly linked to separated leaf drive units 14, 23 via electrical interconnections 12, 13, collaborate with the line current bar 4. The supply voltage delivered by the central control unit 1 is thus delivered via the line current bar 4, the current collector 5 and the electrical interconnection 12, for example, to the leaf drive unit 14. The leaf drive unit 14 comprises a drive 15 in form of an electric motor. In case of a partition wall system, all single components may not need a separate drive 15. It is moreover conceivable that individual components can be mechanically connected to or combined with each other. The drive 15 is supplied with the required supply voltage coming from the leaf drive unit 14 via an electrical interconnection 17. To the inside of the component comprising, for example, the leaf drive unit 14, via an electrical interconnection 19 is linked a component decoder 16, made to decode the data contained in the line current bar 4, the current collector 5 and the electrical interconnection 12. The component decoder 16 sends a reply to the leaf drive unit 14 via an electrical interconnection 18. Via the line current bar 4, these data of the decoder 16 are then sent back to the central control unit 1 in an opposite direction with regard to the received data. In the execution example, the leaf drive unit 14 is connected to a locking 22. The locking 22 is controlled by means of corresponding data that were likewise transmitted to the locking 22 from the central control unit 1 via the line current bar 4, the current collector 5 and the electrical interconnection 12. In an analogous manner a reply is realized via an electrical interconnection 21 to the central control unit 1.

In one case, the partition wall component connected to a leaf drive unit 14, for example in the form of a movable leaf, is conveyed and has a corresponding drive order, this is to say, as already explained in the general description, that the partition wall component drives to a certain position as a result of the transmitted address. This may be realized, for example, likewise via a turnout. The turnout has a turnout drive 2, which receives the corresponding control signal from the central control unit 1 via the line current bar 4 and an intermediate electrical interconnection 7. The turnout drive 2 is simultaneously equipped with a turnout decoder 3 comprising a memory and is thus able to read the received data from the databus and trigger an activation of the turnout drive 2. Similarly, the turnout decoder 3 is linked by an electrical interconnection 8 back to the central control unit 1 via the line current bar 4. In the before described way, numerous components of the partition wall system may be regulated and controlled simultaneously and independently as to speed and also as to their positions. In the execution example described above, the leaf drive unit 14 presents a locking 22, which regularly locks the complete closed wall once placed in the closed position. Another leaf drive element 23 linked likewise to the line current bar 4 via the electrical interconnection 13 with its current collector 6, comprises a drive 25 that is connected to the leaf drive unit 23 via an electrical interconnection 24. This drive 25 also presents a component decoder 26 able to be fed with data via an electrical interconnection 28, and substantially simultaneously data may be read out of the component decoder 26 and returned to the central control unit 1 via an interconnection 27.

In addition to the turnout drive 2 activation described above, another amount of turnouts is conceivable within the partition wall system. For example, another turnout drive 36 is linked to the line current bar 4 via an electrical interconnection 9. Again this turnout drive 36 will present a turnout decoder 10 with a memory. The electrical interconnection 11 provides the reply from the turnout decoder 10 to the central control unit 1.

Figure 2:
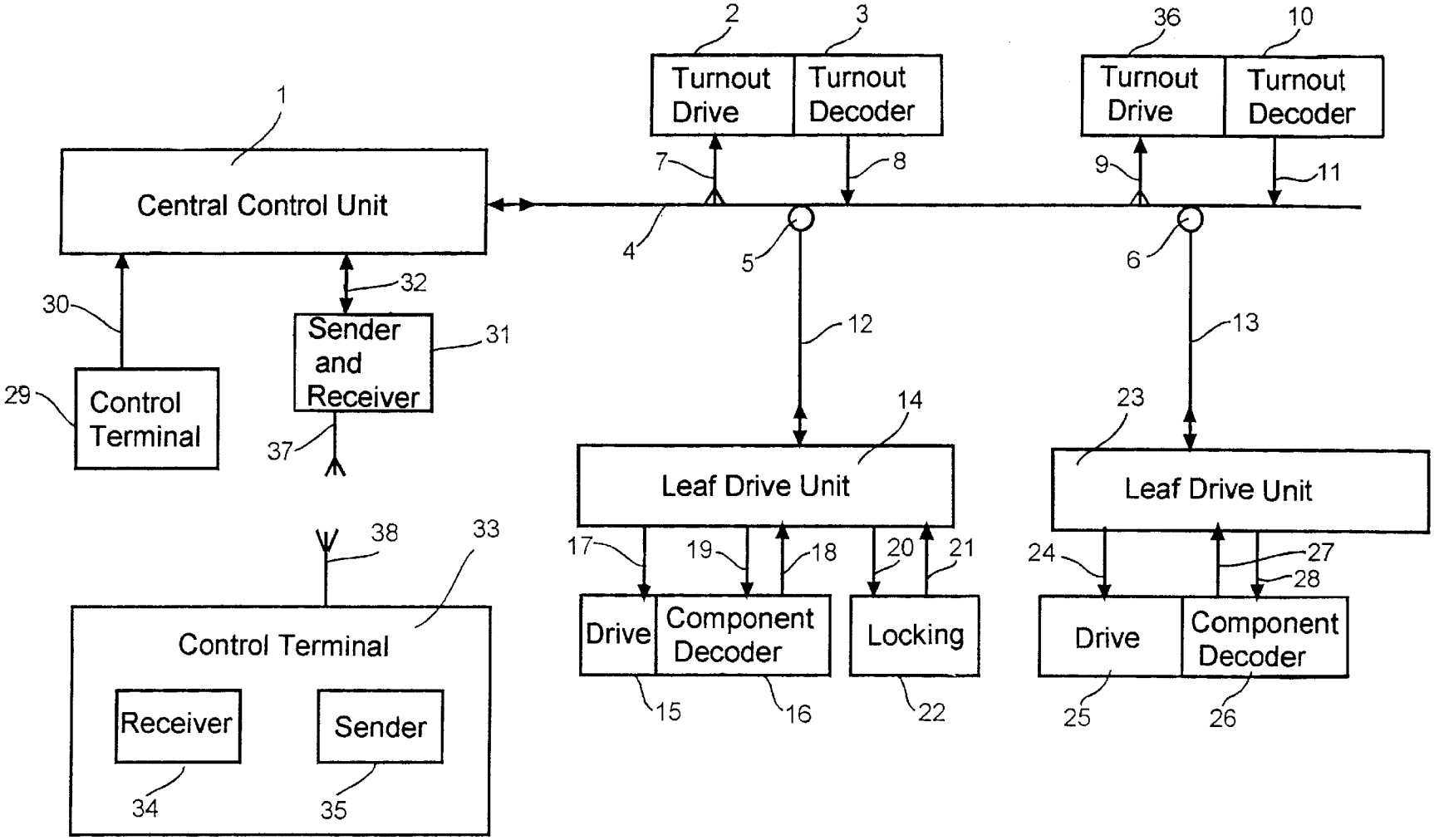
FIG. 2 shows a block diagram as shown in FIG. 1, with the difference that data is radioed.

The control terminal 33 including a receiver 34 and a sender 35 is represented in the execution example in FIG. 2. Via an antenna 38 the relevant signals and data are transmitted to a sender and receiver unit 31 and received by the antenna 37. This sender and receiver unit 31 can either be integrated into the central control unit 1 or it is possible to connect it adaptively to the central control unit 1 and it is thus essentially permanently linked to the central control unit 1 via an electrical interconnection 32.

Figure 3:
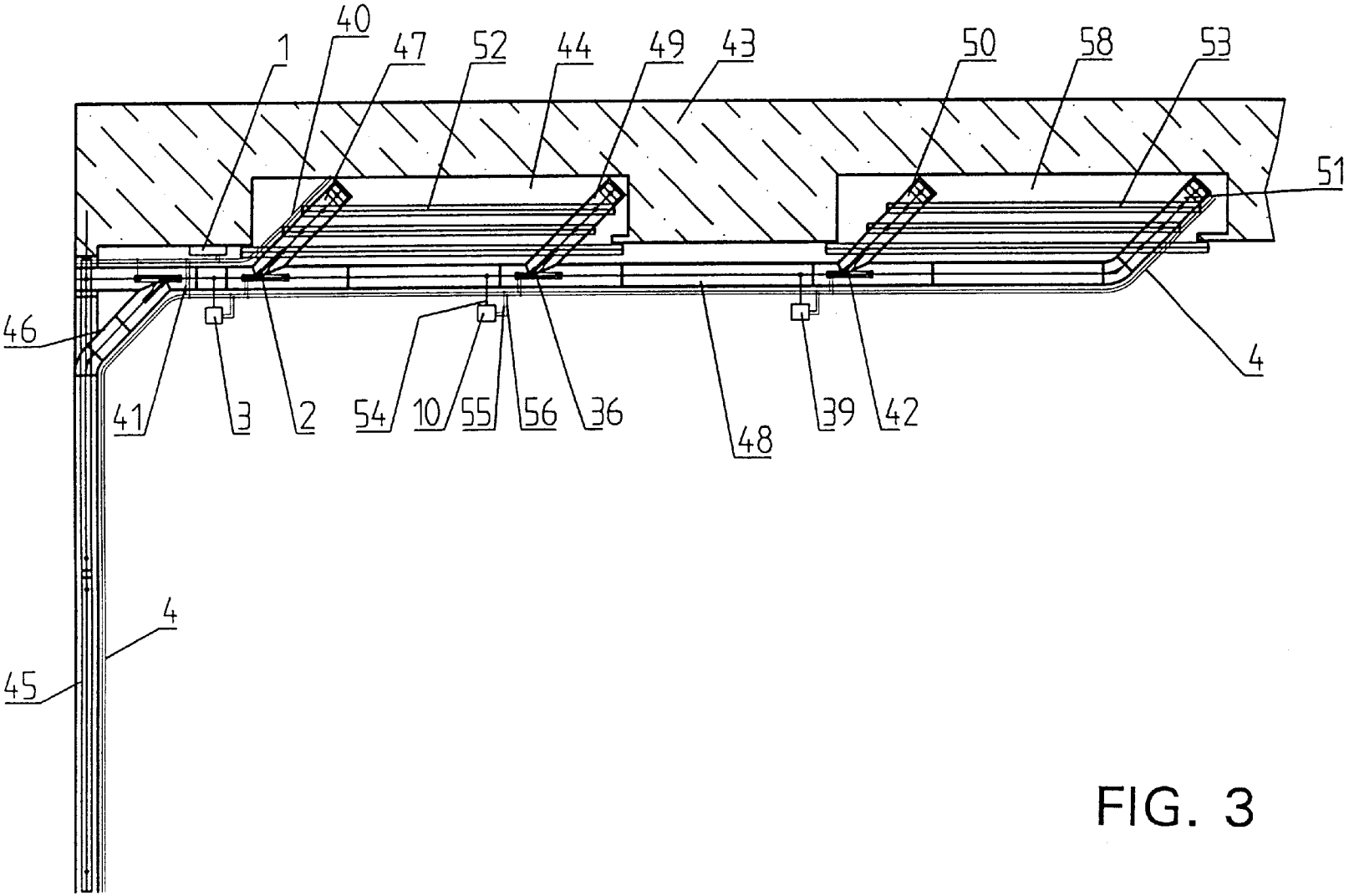
FIG. 3 shows a trimmed area of a partition wall system with a parking station.

In addition to the schematic FIGS. 1 and 2, a partition wall system equipped with guide rails 45 and 48 is shown in FIG. 3. A branch 46 connects these guide rails 45, 48 to each other. Moreover, the guide rail 48 presents branches 47, 49, 50, 51. Turnouts combined with their turnout drives 2, 36, 42 are respectively found at the branches 47, 49, 50, 51. The,turnout drives 2, 36, 42 present each a turnout decoder 3, 10, 39, resepectively. The turnout decoders 3, 10, 39 are linked to the line current bars 4 running alongside the guide rails 45, 48 via electrical interconnections 54, 55, 56, respectively. Substantially imultaneously there is an additional line current bar 40 to control the last leaf, which bar is linked to the line current bar 4 via a corresponding electrical interconnection 41.

The partition wall system components can now be conveyed into their respective parking position, in this special case placed in mural recesses 44, 58. The components 52, 53 are controlled by means of the turnout drives 2, 36, 42 such to be conveyed into their parking position which is located in this special execution example inside a wall 43. The line current bars 4 operate the activation of the turnout drives 2, 36, 42, as well as speed control and positioning of the individual components.

Figure 4:
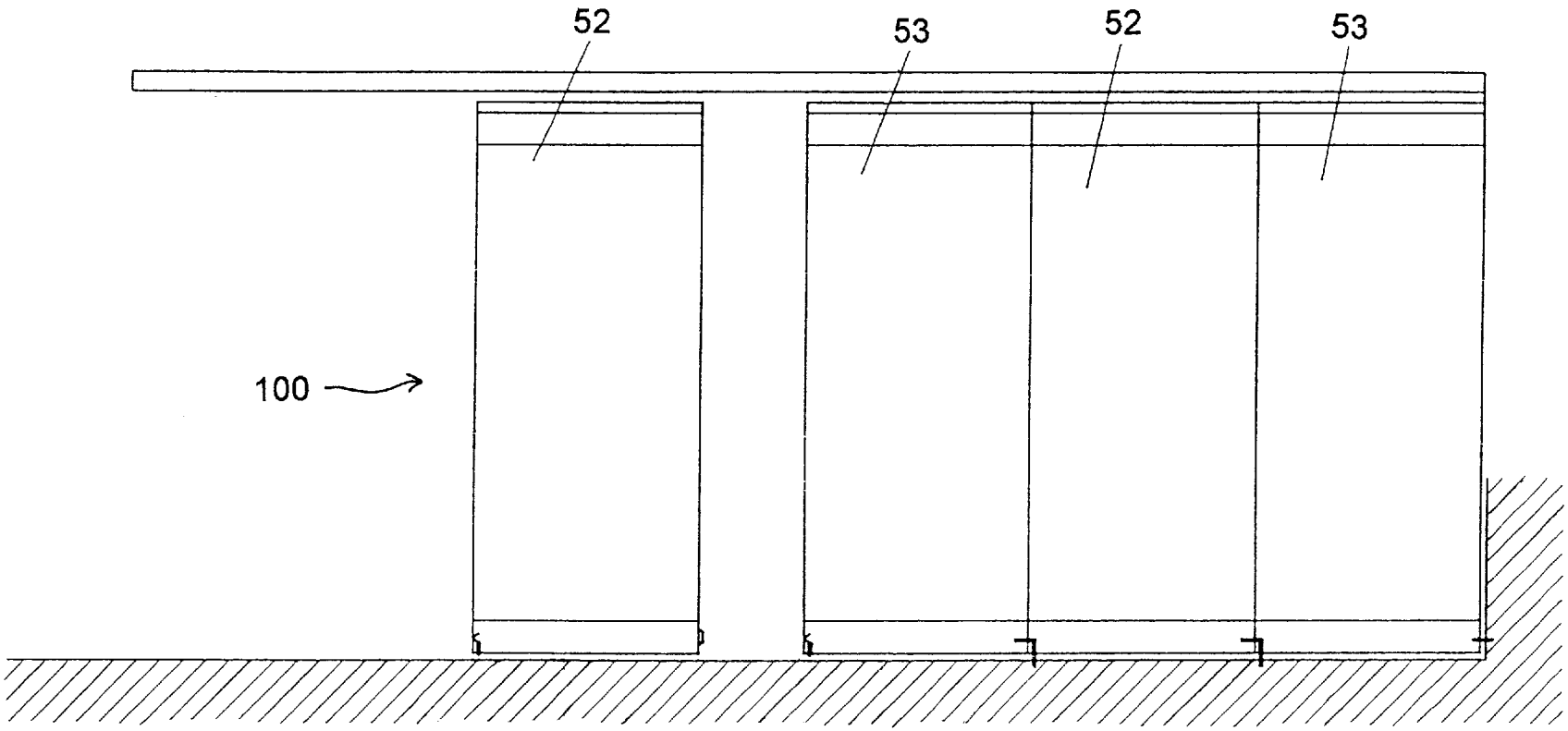
FIG. 4 shows a partition wall system according to at least one possible embodiment of the present invention.

FIG. 4 shows a partition wall system 100 according to at least one possible embodiment of the present invention. Components 52, 53 are also shown. The components 52, 53 can be horizontally movable in the partition wall system 100 in accordance with at least one embodiment of the present invention.

One feature of the invention resides broadly in the drive system for a partition wall system including several individual components 52, 53 supported at or in a hanging bearing from guide rails 45, 48 mounted to a building's ceiling and that are horizontally movable by means of rollers or appropriate media in a technique that the individual components 52, 53 from their lineup arrangement are automatically guided into a parking position 57, whereby at least part of the individual components 52, 53 are equipped with separate drive media in form of leaf drive units 14, 23 that convey the relevant component(s) 52, 53 independently from and/or simultaneously with the other components along the guide rail 45, 48, whereby a central control unit 1 with a microprocessor, several memories, encoders and decoders is provided, and via at least a two-wire connection in form of a databus the central control unit's 1 output signal transmits data and addresses to all leaf drive units 14, 23 simultaneously to activate the individual component's leaf drive units 14, 23, which control unit allows individual control and regulation of the individual components 52, 53 and additional miscellaneous functions for the individual components or in the individual components and whereby the read in or read out and changing of data and addresses is realized by means of a control terminal 29.

Another feature of the invention resides broadly in the drive system for a partition wall system characterized in that the central control unit's 1 output signal is a direct current voltage signal and the leaf drive units 14, 23 include each one direct current motor.

Yet another feature of the invention resides broadly in the drive system for a partition wall system characterized in that the central control unit's 1 output signal is an alternating current voltage signal (low voltage) and the leaf drive units 14, 23 include each one alternating current motor.

Still another feature of the invention resides broadly in the drive system for a partition wall system characterized in that the central control unit 1 digitally prepares data and addresses and serially feeds them by means of a databus.

A further feature of the invention resides broadly in the drive system for a partition wall system characterized in that one digital address is attributed to each individual component 52, 53.

Another feature of the invention resides broadly in the drive system for a partition wall system characterized in that the leaf drive units 14, 23 include at least one decoder and at least one memory and return the received data and addresses to the central control unit 1.

Yet another feature of the invention resides broadly in the drive system for a partition wall system characterized in that the individual components 52, 53 can be conveyed at different speed in partial areas.

Still another feature of the invention resides broadly in the drive system for a partition wall system characterized in that the miscellaneous function consists in automatically activating a locking.

A further feature of the invention resides broadly in the drive system for a partition wall system according to the previous claims, characterized in that the miscellaneous function realizes the control of turnout drives 2, 36, 42 included within the guide rails 45, 48, whereby the turnout drives 2, 36, 42 comprise a turnout memory and a decoder 3, 10 respectively corresponding switching and/or blocking elements.

Another feature of the invention resides broadly in the drive system for a partition wall system characterized in that the leaf drive units' 14, 23 supply voltage is realized by low frequent voltage with a superimposed HF-signal.

Yet another feature of the invention resides broadly in the drive system for a partition wall system characterized in that the line current bars 4 are integrated into the guide rail 45, 48.

Still another feature of the invention resides broadly in the drive system for a partition wall system characterized in that the guide rail 45, 48 is simultaneously employed as line current bar.

A further feature of the invention resides broadly in the drive system for a partition wall system characterized in that the power supply and the data for the databus are transferred by induction.

Another feature of the invention resides broadly in the drive system for a partition wall system characterized in that the data are radioed or transmitted by infrared to the databus.

Some examples of guide rails or systems for door, wall or partition systems which may be utilized or incorporated in an embodiment of the present invention may be found in the following U.S. Pat. No. 5,538,064, issued to inventor Salice on Jul. 23, 1996; No. 5,327,681, issued to inventor Minami on Jul. 12, 1994; No. 4,555,828, issued to inventor Matimura on Dec. 3, 1985; and No. 4,084,289, issued to inventor Naimo on Apr. 18, 1978.

Some examples of movable partition or wall systems and devices for their operation which may be utilized or incorporated in an embodiment of the present invention may be found in the following U.S. Pat. No. 5,930,953, issued to inventor Estfeller on Aug. 3, 1999; No. 5,730,027, issued to inventor Hormann on Mar. 24, 1998; No. 5,461,829, issued to inventors Lehto et al. on Oct. 31, 1995; No. 5,404,675, issued to inventor Schmidhauser on Apr. 11, 1995; No. 5,329,857, issued to inventor Owens on Jul. 19, 1994; No. 5,295,281, issued to inventor Kordes on Mar. 22, 1994; No. 5,394,648, issued to inventor Kordes on Mar. 7, 1995; No. 5,417,013, issued to inventor Tillmann on May 23, 1995; No. 5,544,462, issued to inventor Kordes on Aug. 13, 1996; No. 5,406,761, issued to inventors Hobbiebrunken et al. on Apr. 18, 1995; No. 5,152,332, issued to inventor Siener on Oct. 6, 1992; No. 5,042,555, issued to inventor Owens on Aug. 27, 1991; No. 4,934,119, issued to inventor Ybarra on Jun. 19, 1990; No. 4,914,878, issued to inventors Tamaki et al. on Apr. 10, 1990; No. 4,895,246, issued to inventor Rizzi on Jan. 23, 1990; No. 4,752,987, issued to inventors Dreyer et al. on Jun. 28, 1988; No. 4,596,094, issued to inventors Teller et al. on Jun. 24, 1986; No. 4,555,828, issued to inventor Matimura on Dec. 3, 1985; No. 4,458,462, issued to inventor Schold on Jul. 10, 1984; No. 4,404,770, issued to inventor Markus on Sep. 20, 1983; and No. 4,112,647, issued to inventor Scheid on Sep. 12, 1978.

Some examples of control systems which measure operating parameters and learn therefrom which may be utilized or incorporated in a possible embodiment of the present invention may be found in the following U.S. Pat. No. 5,770,934, issued to inventor Theile on Jun. 23, 1998; No. 5,191,272, issued to inventors Torii et al. on Mar. 2, 1993; No. 5,223,820, issued to inventors Sutterlin et al. on Jun. 29, 1993; and No. 4,655,188, issued to inventors Tomisawa et al. on Apr. 7, 1987.

Some examples of memories which may be utilized or incorporated in a possible embodiment of the present invention may be found in the following U.S. Pat. No. 5,789,887, issued to inventor Elischewski on Aug. 4, 1998; No. 5,770,934, issued to inventor Theile on Jun. 23, 1998; No. 5,453,736, issued to inventor Noren on Sep. 26, 1995; No. 5,315,220, issued to inventors Takimoto et al. on May 24, 1994; No. 4,994,724, issued to inventor Hsu on Feb. 19, 1991; No. 4,498,033, issued to inventors Aihara et al. on Feb. 5, 1985; and No. 4,328,540, issued to inventors Matsuoka et al. on May 4, 1982.

Some examples of microprocessors which may be utilized or incorporated in a possible embodiment of the present invention may be found in the following U.S. Pat. No. 5,770,934, issued to inventor Theile on Jun. 23, 1998; No. 5,653,056, issued to inventor Stark on Aug. 5, 1997; No. 5,647,173, issued to inventors Stark et al. on Jul. 15, 1997; No. 5,625,266, issued to inventor Stark on Apr. 29, 1997; No. 5,479,151, issued to inventors Lavelle et al. on Dec. 26, 1995; No. 5,453,736, issued to inventor Noren on Sep. 26, 1995; No. 5,437,174, issued to inventor Aydin on Aug. 1, 1995; No. 5,274,312, issued to inventor Gerstenkorn on Dec. 28, 1993; No. 5,230,179, issued to inventors Richmond et al. on Jul. 27, 1993; No. 5,142,152, issued to inventor Boiucaner on Aug. 25, 1992; No. 5,140,173, issued to inventors Chau et al. on Aug. 18, 1992No. 5,136,809, issued to inventors Richmond et al. on Aug. 11, 1992; No. 5,132,503, issued to inventor Lee on Jul. 21, 1992; No. 4,980,618, issued to inventors Milnes et al. on Dec. 25, 1990; No. 4,831,509, issued to inventors Jones et al. on May 16, 1989; No. 4,815,046, issued to inventor Dorr on Mar. 21, 1989 and No. 4,779,240, issued to inventor Dorr on Oct. 18, 1988.

Some examples of open-loop control systems which may be utilized or incorporated in a possible embodiment of the present invention may be found in the following U.S. Pat. No. 5,770,934, issued to inventor Theile on Jun. 23, 1998; No. 5,210,473, issued to inventor Backstrand on May 11, 1993; No. 5,320,186, issued to inventors Strosser et al. on Jun. 14, 1994and No. 5,369,342, issued to inventors Rudzewicz et al. on Nov. 29, 1994.

Some examples of closed-loop control circuits which may be utilized or incorporated in a possible embodiment of the present invention may be found in the following U.S. Pat. No. 5,770,934, issued to inventor Theile on Jun. 23, 1998; No. 5,189,605, issued to inventors Zuehlke et al. on Feb. 23, 1993; No. 5,223,072, issued to inventors Brockman et al. on Jun. 29, 1993; and No. 5,252,901, issued to inventors Ozawa et al. on. Oct. 12, 1993.

Some examples of look up tables accessed by computers or microprocessors which may be utilized or incorporated in a possible embodiment of the present invention may be found in the following U.S. Pat. No. 5,284,116, issued to inventor Richeson, Jr. on Feb. 8, 1994; No. 5,359,325, issued to inventors Ford et al. on Oct. 25, 1994; and No. 5,371,537, issued to inventors Bohan et al. on Dec. 6, 1994.

Some examples of databuses or databus systems which may be utilized or incorporated in an embodiment of the present invention may be found in the following U.S. patents: No. 6,008,546, issued to inventor Sage on Dec. 28, 1999; No. 5,978,193, issued to inventor Kaaden on Nov. 2, 1999; No. 5,815,732, issued to inventors Cooper et al. on Sep. 29, 1998; No. 5,507,001, issued to inventor Nishizawa on Apr. 9, 1996; No. 5,402,423, issued to inventors Van Kersen on Mar. 28, 1995; No. 4,725,838, issued to inventors Maschek et al. on Feb. 16, 1998; No. 4,720,155, issued to inventors Schildkraut et al. on Jan. 19, 1988; and No. 4,488,066, issued to inventor Shoji on Dec. 11, 1984.

Some examples of turnouts or turnout switches which may be utilized or incorporated in an embodiment of the present invention may be found in the following U.S. Pat. No. 5,577,691, issued to inventors Erich et al. on Nov. 26, 1996; No. 5,375,797, issued to inventor Willow on Dec. 27, 1994; No. 4,970,964, issued to inventors Burg et al. on Nov. 20, 1990; No. 4,970,962, issued to inventors Burg et al. on Nov. 20, 1990; No. 4,890,804, issued to inventors Teramoto et al. on Jan. 2, 1990; and No. 4,005,839, issued to inventor Frank on Feb. 1, 1977.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 198 19,279.7, filed on Apr. 30, 1998, having inventor Reinhard Janutta, and DE-OS 198 19 279.7 and DE-PS 198 19 279.7 and International Application No. PCT/EP99/00030, filed on Jan. 6, 1999, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed:

1. Drive system for a partition wall system including several individual movable leaves supported at or in a hanging bearing from guide rails mounted to a building's ceiling, which movable leaves are horizontally movable by drive devices having rollers such that the individual movable leaves are automatically guided from their line-up arrangement into a parking position; at least part of the individual movable leaves being equipped with separate drive devices in form of leaf drive units that convey the relevant movable leaf or movable leaves independently from and/or simultaneously with the other movable leaves along the guide rail; a central control unit with a microprocessor, a plurality of memories, encoders and decoders; a two-wire connection in the form of a databus; said microprocessor being connected to said memories, said encoders and decoders, and said databus; said databus being configured to transmit the central control unit's output signal data and addresses to and from said leaf drive units substantially simultaneously to activate the individual movable leaf's leaf drive units, said control unit being configured to permit individual control and regulation of the individual movable leaves and operating functions at least one of:

for the individual movable leaves and in the individual movable leaves; and the read in or read out and changing of data and addresses is realized by means of a control terminal; said control terminal being configured to change data and addresses in the various movable leaves.

2. Drive system for a partition wall system according to claim 1, wherein the central control unit's output signal is a direct current voltage signal and the leaf drive units each include one direct current motor.

3. Drive system for a partition wall system according to claim 1, wherein the central control unit's output signal is an alternating current voltage signal (low voltage) and the leaf drive units each include one alternating current motor.

4. Drive system for a partition wall system according to claim 1, wherein the central control unit digitally prepares data and addresses and serially feeds said data and addresses by means of a databus.

5. Drive system for a partition wall system according to claim 1, wherein one digital address is attributed to each one of said movable leaves.

6. Drive system for a partition wall system according to claim 4, wherein one digital address is attributed to each one of said movable leaves.

7. Drive system for a partition wall system according to claim 1, wherein the leaf drive units include at least one decoder and at least one memory and return the received data and addresses to the central control unit.

8. Drive system for a partition wall system according to claim 6, wherein the leaf drive units include at least one decoder and at least one memory and return the received data and addresses to the central control unit.

9. Drive system for a partition wall system according to claim 1, wherein the individual movable leaves can be conveyed at different speeds in partial areas.

10. Drive system for a partition wall system according to claim 8, wherein the individual movable leaves can be conveyed at different speeds in partial areas.

11. Drive system for a partition wall system according to claim 1, wherein the operating function consists in automatically activating a locking.

12. Drive system for a partition wall system according to claim 1, wherein the operating function realizes the control of turnout drives included within the guide rails, whereby the turnout drives comprise a turnout memory and a decoder and, respectively, corresponding switching and/or blocking elements.

13. Drive system for a partition wall system according to claim 10, wherein the operating function realizes the control of turnout drives included within the guide rails, whereby the turnout drives comprise a turnout memory and a decoder and, respectively, corresponding switching and/or blocking elements.

14. Drive system for a partition wall system according to claim 1, wherein the leaf drive units' supply voltage is realized by a low frequency voltage with a superimposed HF-signal.

15. Drive system for a partition wall system according to claim 3, wherein the leaf drive units' supply voltage is realized by a low frequency voltage with a superimposed HF-signal.

16. Drive system for a partition wall system according to claim 1, wherein the line current bars are integrated into the guide rail.

17. Drive system for a partition wall system according to claim 1, wherein the guide rail is simultaneously employed as line current bar.

18. Drive system for a partition wall system according to claim 1, wherein the power supply and the data for the databus are transferred by induction.

19. Drive system for a partition wall system according to claim 1, wherein the data are radioed or transmitted by infrared to the databus.

20. Partition wall system having a drive system, which partition wall system including several individual movable leaves supported at or in a hanging bearing from guide rails mounted to a building's ceiling, which movable leaves are horizontally movable by drive devices having rollers such that the individual movable leaves are automatically guided from their line-up arrangement into a parking position; at least part of the individual movable leaves being equipped with separate drive devices in form of leaf drive units that move their corresponding movable leaf or movable leaves independently from and/or simultaneously with the other movable leaves along the guide rail; a central control unit with a microprocessor, a plurality of memories, encoders and decoders; at least a two-wire connection in the form of a databus; said microprocessor being connected to said memories, said encoders and decoders, and said databus; said databus being configured to transmit the central control unit's output signal data and addresses to and from said leaf drive units substantially simultaneously to activate the individual movable leaf's leaf drive units, said control unit being configured to permit individual control and regulation of the individual movable leaves and operating functions at least one of:

for the individual movable leaves and in the individual movable leaves; and the read in or read out and changing of data and addresses is realized by means of a control terminal; said control terminal being configured to change data and addresses in the various movable leaves.

* * * * *

UNITED STATES PATENT AND TRADEMARK OFFICE

CERTIFICATE OF CORRECTION

PATENT NO. : 6,313,594 B1
DATED : November 6, 2001
INVENTOR(S) : Reinhard Janutta It is certified that error appears in the above-identified patent and that said Letters Patent is hereby corrected as shown below:

Title page,
Item [56], References Cited, insert the following:

-- OTHER DOCUMENTS
Catalog excerpt from Busch-Jaeger Elektro GmbH - BUSCH-NETZBUS X-10 --.

Column 10,
Line 59, after 'Aug. 18,' delete "1992No." and substitute -- 1992; No. --.

Column 11,
Line 5, after 'June. 14,' delete "1994and" and substitute -- 1994; and --.

Signed and Sealed this

Twenty-fourth Day of September, 2002

*Attest:*

*Attesting Officer*

JAMES E. ROGAN
*Director of the United States Patent and Trademark Office*